US005811158A

United States Patent [19]

Yasuda et al.

[11] Patent Number: 5,811,158

[45] Date of Patent: Sep. 22, 1998

[54] METHOD AND APPARATUS FOR ELECTROSTATIC POWDER COATING

[75] Inventors: Shinichiro Yasuda, Tokyo; Masayuki Maruta; Yukiya Sato, both of Wakayama, all of Japan

[73] Assignee: Kao Corporation, Tokyo, Japan

[21] Appl. No.: 844,775

[22] Filed: Apr. 22, 1997

[30] Foreign Application Priority Data

Apr. 25, 1996 [JP] Japan ..... 8-131414
Feb. 10, 1997 [JP] Japan ..... 9-041523

[51] Int. Cl.[6] ..... B05D 1/06

[52] U.S. Cl. ..... 427/475; 427/485; 427/486; 118/629

[58] Field of Search ..... 427/475, 485, 427/482, 486; 118/629

[56] References Cited

U.S. PATENT DOCUMENTS 3,903,321 9/1975 Schaad .
4,248,744 2/1981 Masar et al. .
4,908,225 3/1990 Niimura et al. ..... 427/25
5,073,579 12/1991 Macholdt et al. ..... 524/255
5,319,001 6/1994 Morgan et al. ..... 523/205

FOREIGN PATENT DOCUMENTS

A10306799 3/1989 European Pat. Off. .
2682309 4/1993 France .
A13232088 3/1984 Germany .
4-504431 8/1992 Japan .
90 06345 6/1990 WIPO .
94/11446 5/1994 WIPO .

*Primary Examiner*—Shrive Beck
*Assistant Examiner*—Fred J. Parker
*Attorney, Agent, or Firm*—Birch, Stewart, Kolasch & Birch, LLP

[57] ABSTRACT

While plural kind of powder paints of different hues are mixed with each other without melting for preparation of a powder paint of a desire hue, a fluidity improver possessing a charge control function is simultaneously mixed into the powder paints without melting. The mixed powder paint containing the fluidity improver is charged, and then electrostatic powder coating is performed by the charged powder paint.

7 Claims, 1 Drawing Sheet

METHOD AND APPARATUS FOR ELECTROSTATIC POWDER COATING

FIELD OF THE INVENTION

The present invention relates to a method and apparatus for electrostatic powder coating.

DESCRIPTION OF RELATED ART

In recent years, many efforts have been made on an international level to prevent the deterioration of the global environment, because changes of the global environmental generate problems. In the field of coating technology, paint containing organic solvent generates various problems, for example, public pollution due to organic solvent spilled by coating work, environmental pollution due to volatile organic compound (VOC), and malodor. To resolve these problems, high-solid paint, aqueous paint, and methods of powder coating have been developed. The powder coating, in particular, is free from the problems of public pollution and hazards due to organic solvents, because it uses powder paint containing no organic solvent, so that it is useful to resolve the above problems. Other advantages of the powder coating are ease of thick coating and automated operation.

The electrostatic powder coating is one of the methods of powder coating. It uses powder paint positively or negatively charged to form a coating film on the earthed subject of coating by blowing the powder paint.

In powder coating, however, many powder paints of different hues are required, thus necessitating a vast storage area for the powder paints.

Also, it is difficult to have a number of electrostatic powder coating guns corresponding to the number of the hues of the powder paints. For this reason, in case of forming plural coating films of plural hues, an exchange of a powder paint of one hue for another powder paint of another hue must be frequently performed to blow them from one electrostatic powder coating gun. However, this exchange of the powder paints takes long time, so that actual operating time is extremely reduced.

Also, in case of forming plural coating films of plural hues, the amounts of powder paints of different hues are hardly equal to each other. Therefore, a great amount of powder paints remains unused. Disposal of the remaining powder paints results in increased cost. Storage instead of the disposal of the remaining powder paints results in deteriorated chargeability of the powder paints; this in turn decreases coating efficiency and reduces productivity. Furthermore, coating efficiency reduction necessitates the recovery of the powder paints, which cannot be adhered to the subject of coating, for recycled use. However, the recycled powder paint is problematic in that it is inferior to fresh paints in terms of coating performance, so that it is incapable of forming a uniform coating film.

Regarding powder paint production, a binder resin, a hardener, other additives, etc., and a prepared pigment are first mixed by using a mechanical mixer, then kneaded in a molten state. After being cooled, the mixture is milled to a given particle size to yield a powder paint for testing. Test coating is conducted by using the powder paint to form a coating film. If the hue of the coating film is not the desired one, the powder paint for testing is supplemented with another pigment to obtain another powder paint for testing. This process must be repeated until the desired hue is obtained. Also, when problems due to heat hysteresis must be avoided, another powder paint for testing must be produced from a new binder resin, hardener, other additives, etc., and a newly prepared pigment. In short, the preparation of a powder paint of a desired hue takes a great deal of labor and time.

To resolve these problems, a conventional method has been proposed in which a powder paint of a desired hue is prepared by mixing plural kinds of powder paints of different hues (National Publication No. H4-504431 for International Application).

When the conventional method is used for the preparation of a powder paint of a desired hue, however, a uniform hue cannot be obtained, if the mean diameter of the starting particles is greater than 10 $\mu$m. That is, the diameter of particles constituting powder paint has a significant influence on the obtainment of a uniform hue.

In the conventional method described above, the preparation of a powder paint of a desired hue is performed by simply mixing plural kinds of powder paints of different hues. It should be noted, however, that different kinds of powder paints differ from each other in terms of physical properties such as fluidity and chargeability. Because such different kinds of powder paints of different physical properties are difficult to uniformly mix together, the mixed powder paint is difficult to be uniformly charged. For this reason, in the conventional method, the diameter of the starting particles must be decreased to improve the uniformity of the powder paint, and the starting particles must be granulated after the mixing.

Also, powder paints often undergo chargeability reduction during a period of several days from the production date, even when they are sufficiently chargeable at the time of production. This can result in decreased coating efficiency and hence hamper the obtainment of a uniform coating film.

The present invention is directed to provide a method and apparatus for electrostatic powder coating capable of resolving the above-described problems.

SUMMARY OF THE INVENTION

The electrostatic powder coating method of the present invention comprises the steps of mixing plural kinds of powder paints of different hues without melting for preparation of a powder paint of a desired hue, mixing a fluidity improver, which possesses a charge control function, into the powder paints simultaneous with said mixing step without melting, charging the mixed powder paint containing the fluidity improver, and coating a subject of electrostatic powder coating by the charged powder paint.

According to the method of the present invention, a powder paint of a desired hue is prepared by mixing plural kinds of powder paints without melting and granulation. In this operation, the plural kinds of powder paints can be uniformly mixed with each other via the fluidity improver possessing a charge control function, by mixing the fluidity improver into the powder paints simultaneously with the mixing step without melting. Therefore, it is possible to reduce or eliminate the charge amount difference between the plural kinds of powder paints, when the mixed powder paint containing the fluidity improver is charged. That is, the powder paint of a desired hue can be uniformly charged. By performing the electrostatic powder coating with the uniformly charged powder paint, a uniformly coating film of a uniform hue can be formed. Thereby, a powder paint of a uniform hue can be obtained from plural kinds of powder paints without melting and granulating, and the influence of the diameter of particles constituting the powder paint can be reduced.

The fluidity improver improves the fluidity of the powder paint by inhibiting the direct contact of the particles constituting the powder paint with each other. The fluidity improver can be constituted of fine particles smaller than the particles constituting the powder paint. By coating each of the fine particles constituting the fluidity improver with a substance that positively or negatively charges the powder paint, the fluidity improver can obtain a charge control function.

The ratio of the fluidity improver to the plural kinds of powder paints is preferably 0.05 to 1% by weight, more preferably 0.1 to 0.5% by weight. If the ratio is lower than 0.05% by weight, the fluidity improving effect is insufficient. If the ratio exceeds 1% by weight, free particles are increased, so that the surrounding environment is polluted, the charge amount is decreased, and the strength of adhesion between the coating film and the subject of coating is reduced.

In the method of the present invention, it is preferable that the mixing of the powder paints and fluidity improver, the charging of the mixed powder paint, blowing of the charged powder paint to the subject of coating are continuously performed, with the powder paints and the fluidity improver being transported. This enables the continuous performance of the preparation of the powder paint of a desired hue, the charging, and the coating. As a result, coating efficiency and coating film uniformity can be improved, because the coating is possible without loss of the chargeability of the powder paint of a desired hue.

It is preferable to mix the powder paints with the fluidity improver by rotating a rotary element having a blade by pressurized air, which transports the powder paints and the fluidity improver, in the transportation path for the powder paints and the fluidity improver. By this arrangement, the mixing can be performed by utilizing the pressurized air that transports the powder paint and the fluidity improver.

The electrostatic powder coating apparatus of the present invention comprises a body; plural powder paint inlets formed in the body; a fluidity improver inlet formed in the body; an outlet formed in the body; and a transportation path within the body for communicating each of the inlets with the outlet; wherein the transportation path has a mixing space and a charging space positioned in the downstream side of the mixing space; wherein means for mixing the powder paints, which are introduced from the powder paint inlets, and the fluidity improver, which is introduced from the fluidity improver inlet, is provided in the mixing space; wherein means for charging the mixed powder paint containing the fluidity improver is provided in the charging space; and wherein the charged powder paint can be blown out from the outlet. It is preferably that a rotary element having a blade rotated by the pressure of air introduced from the powder paint inlets and the fluidity improver inlet is provided in the mixing space, and the powder paints and the fluidity improver is mixed with each other by the rotation of the rotary element.

According to the electrostatic powder coating apparatus of the present invention, the preparation of a powder paint of a desired hue based on mixing of plural kinds of powder paints, the charging of the prepared powder paint, and the coating by the charged powder paint can be continuously performed, with the plural kinds of powder paints and the fluidity improver being transported. Therefore, this apparatus is suited for the performance of the above method of the present invention.

According to the present invention, a uniform coating film of uniform hue can be formed without excessively reducing the diameter of powder paint particles in electrostatic powder coating, when a powder paint of a desired hue is prepared from plural kinds of powder paints of different hues. It is also possible to improve coating efficiency and coating film uniformity without reducing the chargeability of the prepared powder paint.

DETAILED DESCRIPTION OF PREFERRED EMBODIMENT

Figure 1:
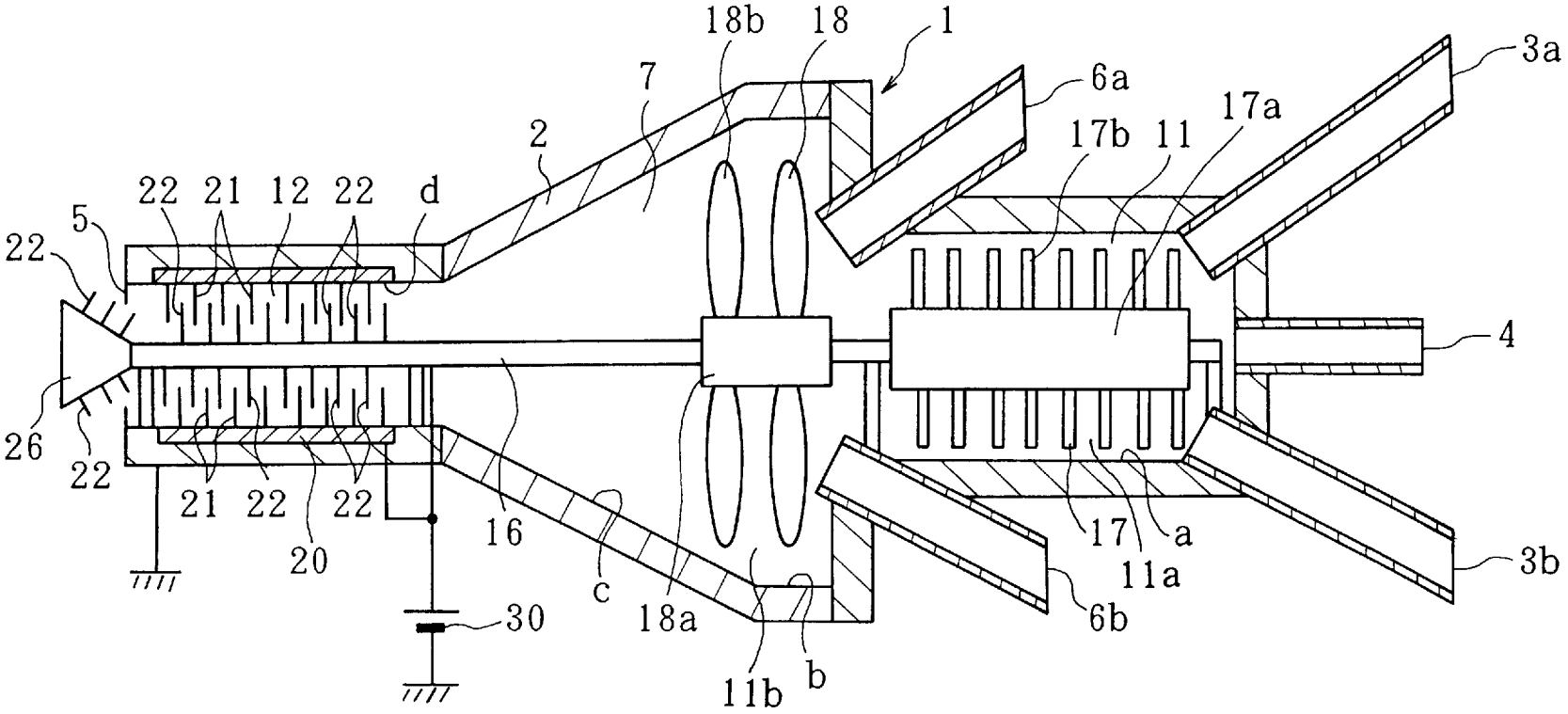
FIG. 1 is an oblique view of the electrostatic powder coating apparatus of an embodiment of the present invention.

The electrostatic powder coating apparatus 1 illustrated in FIG. 1 has a body 2, two powder paint inlets 3*a* and 3*b* formed at one end of the body 2, a fluidity improver inlet 4 formed at one end of the body 2, an outlet 5 formed at the other end of the body, two pressurized air inlets 6*a* and 6*b* formed on the outer circumference of the body 2, and a transportation path 7 provided within the body 2 to communicate each of the inlets 3*a*, 3*b*, 4, 6*a* and 6*b* with the outlet 5.

The body 2 has a shape of body of rotation. The body 2 is preferably formed from an insulating material or coated with an insulating material such as rubber. The transportation path 7 has a mixing space 11 arranged along the axial direction of the body 2, and a charging space 12 positioned in the downstream side of the mixing space 11. The mixing space 11 has a first mixing portion 11*a* and a second mixing portion 11*b*. The first mixing portion 11*a* is surrounded by a cylindrical face "a". The second mixing portion 11*b* is surrounded by a cylindrical face "b" whose diameter is greater than the inside diameter of the first mixing portion 11*a*, and by a conical face "c" that tapers toward the outlet 5. The charging space 12 is surrounded by a cylindrical face "d".

Powder paints transported by pressurized air from the powder paint inlets 3*a* and 3*b*, and a fluidity improver transported by pressurized air from the fluidity improver inlet 4 are introduced into the first mixing portion 11*a*.

A first rotary element 17 is supported in the first mixing portion 11*a* by a support element 16, which is fixed to the body 2 so as to be rotatable around the axis of the body 2. This first rotary element 17 has a shape like an auger by having a cylindrical hub 17*a* and blades 17*b* arranged along a spiral on the outer circumference of the hub 17*a*. This first rotary element 17 is rotated by the pressure of air introduced from the inlets 3*a*, 3*b* and 4. By this rotation of the first rotary element 17, the powder paints and fluidity improver introduced into the first mixing portion 11*a* are mixed with each other without melting.

In the second mixing portion 11*b*, a second rotary element 18 is supported by the support element 16 so as to be rotatable around the axis of the body 2. This second rotary element 18 has a cylindrical hub 18*a* and blades 18*b* provided on the outer circumference of the hub 18*a*. This second rotary element 18 is rotated by the pressure of air introduced from the inlets 3*a*, 3*b*, 4, 6*a* and 6*b*. The rotation rate of this second rotary element 18 is greater than that of the first rotary element 17. By this rotation of the second rotary element 18, the powder paints and fluidity improver introduced into the second mixing portion 11*b* are stirred, whereby the powder paints and the fluidity improver are uniformly dispersed and mixed with each other without melting. The rotation rate of each of the rotary elements 17 and 18 is set so as to ensure a sufficient powder paint blowing capacity without frictional melting of the powder paint.

The cylindrical face "d" on the inner circumference of the charging space 12 is constituted of the inner circumference of a cylindrical element 20 bonded to the inner circumference of the body 2. The cylindrical element 20 is made of, for example, a flexible square plate-like material, which is cylindrically curved. By the cylindrical face "d", plural first linear elements 21 are cantilevered so that the elements 21 are flexible. These first linear elements 21 extend toward the charging space 12 along the radial direction of the cylindrical face "d" like a brush. Also, by the support element 16, second linear elements 22 are cantilevered so as to be flexible. These second linear elements 22 extend toward the charging space 12 along the radial direction of the cylindrical face "d" like a brush. A diffusion element 26 for diffusing the mixed powder paint at the outlet 5 is attached to the tip of the support element 16, and the second linear elements 22 are attached to the diffusion element 26. By this arrangement, each of the linear elements 21 and 22 arranged in the transportation path 7 is capable of coming in contact with the mixed powder paint on transportation.

A power source 30 for charging the linear elements 21 and 22 is provided. The power source 30 is connected to the support element 16 and the cylindrical element 20 at one electrode and earthed at the other electrode. The material of the support element 16, the cylindrical element 20, and the linear elements 21 and 22 is electroconductive substance. By this arrangement, frictional charging of the powder paint as described below is promoted by the charge to the linear elements 21 and 22. The insulating portion of the body 2 is preferably earthed.

The material of each of the linear elements 21 and 22 is electroconductive substance, such as a metal or an organic high molecular compound containing electroconductive particles, which enables the powder paint to be charged by static electricity generated by friction between the powder paint and the elements 21 and 22. The radius and number of the linear elements 11 and 22 are set so as to ensure a sufficient powder paint blowing capacity.

For performing coating by the above-described electrostatic powder coating apparatus 1, two kinds of powder paints of different hues are introduced from the respective powder paint inlets 3*a* and 3*b* into the first mixing portion 11*a* of the mixing space 11. Simultaneously, a fluidity improver is introduced from the fluidity improver inlet 4 into the first mixing portion 11*a*. The two kinds of powder paints and the fluidity improver are then simultaneously mixed with each other without melting by rotation of the first rotary element 17, and then they are simultaneously mixed with each other without melting by rotation of the second rotary element 18. By this mixing of the two kinds of powder paints in the mixing space 11, a powder paint of a desired hue is prepared. By this two-step mixing, the fluidity improver, whose particle diameter is smaller than the particle diameter of the powder paint, can be mixed into the powder paints and prevented from scattering.

The ratio of the fluidity improver to the two kinds of powder paints is preferably 0.05 to 1% by weight, more preferably 0.1 to 0.5% by weight.

The mixed powder paint containing the fluidity improver is then charged in the charging space 12 by static electricity generated by friction between the powder paint and the linear elements 21 and 22, and then the charged powder paint is blown out from the outlet 5 to the subject of coating to form a coating film. By this arrangement, the mixing of the powder paints and the fluidity improver, the charging of the mixed powder paint, and the blowing of the charged powder paint to the subject of coating can be continuously performed, with the powder paints and the fluidity improver being transported.

According to the above-described electrostatic powder coating method, the two types of powder paints and the fluidity improver possessing a charge control function can be uniformly and simultaneously mixed with each other without melting. Therefore, it is possible to reduce or eliminate the charge amount difference between the two kinds powder paints, when the mixed powder paint containing the fluidity improver is charged. That is, the prepared powder paint of a desired hue can be uniformly charged. By performing an electrostatic powder coating by the uniformly charged powder paint, a uniform coating film of a uniform hue can be formed. By this arrangement, the influence of the diameter of powder paint particles can be reduced in obtaining a powder paint of a uniform hue. In other words, a uniform coating film of a uniform hue can be formed even when the diameter of the powder paint particles is not less than 10 $\mu$m.

According to the above-described electrostatic powder coating apparatus 1, ozone odor is not generated, the entry of powder paint into the hollows of the subject of coating is good, and craters and pinholes are unlikely to occur in the coating film, because the powder paint is charged by static electricity generated by friction. This facilitates the obtainment of a smooth uniform coating film with minimum dust adhesion. The static electricity is generated by contact of linear elements 21 and 22 with the powder paint; the chance of the contact increases in proportion to the number of linear elements 21 and 22. By this arrangement, the charge efficiency of the powder paint particles can be improved significantly. The maximum powder paint blowing capacity and the coating efficiency can be increased by the improvement of the charge efficiency, so that quick coating is possible even when the subject of coating has a wide surface area. Because the linear elements 21 and 22 are flexible by the contact with the powder paint, wear of the element 21 and 22 by the contact is mitigated, resulting in extended life of this apparatus 1. Also, because the flexibility of the linear elements 21 and 22 prevents the powder paint from accumulating on the elements 21 and 22, the powder paint can be stably charged. Also, because structural simplicity reduces cost and facilitates maintenance and cleaning, the use of the powder paints of different hues is facilitated.

The fluidity improver of the present invention improves the fluidity of the powder paint by inhibiting the direct contact of the particles constituting the powder paint with each other. The fluidity improver can be constituted of fine particles smaller than the particles constituting the powder paints. The fluidity improver is exemplified by fine particles of, for example, silica, aluminium oxide, titanium oxide, barium titanate, magnesium titanate, calcium titanate, strontium titanate, zinc oxide, siliceous sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride; fine particles of silica are especially preferred.

The fine particles of silica have an Si—O—Si bond and can be produced by the dry or wet method. Also, the fine particles of silica can contain aluminum silicate, sodium silicate, potassium silicate, magnesium silicate, zinc silicate, etc., in addition to anhydrous silicon dioxide, and preferably contain not less than 85% by weight of $SiO_2$.

By coating the fine particles constituting the fluidity improver with a substance that positively or negatively charges the powder paint, the fluidity improver obtains a charge control function; as the coating substance, silane-based coupling agents, titanium-based coupling agents, silicon oil, and silicon oil having an amine on the side chain thereof are useful.

Each of the plural kinds of powder paints to be mixed in the present invention can be produced in the same manner as in conventional methods. For example, a binder resin, a hardener, other additives, etc., and plural pigments are mixed by using a mechanical mixer, after which the mixture is kneaded in a molten state. After being cooled, the mixture is milled and classified by size to yield the powder paint. It is also possible to use powder paints, each of which is obtained by adding a hardener, other additives, etc., and plural pigments to a monomer for polymerization, dispersing them in the monomer, then conducting solution polymerization or suspension polymerization. For obtaining a coating film of a uniform hue, the mean particle diameter of the powder paint is preferably as small as possible.

For uniformly mixing two or more kinds of powder paints, the loose apparent density difference between the powder paints to be mixed is preferably within 0.02 g/cc.

For uniformly coating the subject by the powder paint, the charge amount difference between the powder paints to be mixed is preferably within 5 $\mu$C/g, the dielectric constant difference is preferably within 0.2, and the resistance ratio is preferably between 1/10 and 10.

For uniformly setting the coated powder paint, it is preferable that the softening point difference between the powder paints to be mixed is within 5° C., that the melt viscosity difference at 120° C. is within 300 cp, more preferably within 100 cp, and that the setting time difference is within 2 minutes, more preferably within 1 minute.

Each kind of the powder paint to be mixed in the present invention can contain a charge control agent as necessary. The charge control function of this charge control agent contained in the powder paint to be mixed corresponds to the charge control function of the above-described fluidity improver. To be more precise, when the fluidity improver positively charges the mixed powder paint, the charge control agent positively charges the powder paint to be mixed; and when the fluidity improver negatively charges the mixed powder paint, the charge control agent negatively charges the powder paint to be mixed.

The charge control agent contained in the powder paint to be mixed is not subject to limitation. Negative charge control agents include, for example, metal-containing azo dyes like copper phthalocyanine dyes such as "Barifast Black 3804", "Bontron S-31", "Bontron S-32", "Bontron S-34", "Bontron S-36" (all produced by Orient Chemical Ind. Ltd.) and "Aizenspilon Black TVH" (produced by Hodogaya Chemical Ind. Ltd.); salicylic acid alkyl derivative metal complexes such as "Bontron E-85" (produced by Orient Chemical Ind. Ltd.); and quaternary ammonium salts such as "Copy Charge NX VP434" (produced by Hoechst Aktigen Gesellshaft).

Positive charge control agents include, for example, imidazole derivatives such as "PLZ-2001" and "PLZ-8001" (both produced by Shikoku Chemicals Corp.); triphenylmethane derivatives such as "COPY BLUE PR" (produced by Hoechst Aktigen Gesellshaft); quaternary ammonium salt compounds such as "Bontron P-51" (produced by Orient Chemical ind. Ltd.), "Copy Charge PX VP435" (produced by Hoechst Aktigen Gesellshaft) and cetyltrimethylammonium bromide; and polyamine resins such as "AFP-B" (produced by Orient Chemical Ind. Ltd.).

The present invention is not limited to the above-described embodiment. For example, the present invention is applicable to a case where a powder paint of a desired hue is prepared by mixing different powder paints of three or more hues. For example, by mixing powder paints of the three primary colors, that is, yellow, magenta, and cyan, a powder paint of an arbitrary desired hue can be obtained. The present invention is applicable to preparing a powder paint of a desired hue by mixing powder paints of at least two hues. It is possible to use an electrostatic powder coating apparatus which has a corona electrode, which is positioned at a powder paint outlet, and a high-voltage generator for applying a high voltage of, for example, 70 to 100 KV, to the corona electrode, so as to charge the powder paint by corona discharge from the corona electrode. Also, it is possible to use an electrostatic powder coating apparatus, which generates static electricity to charge the powder paint by friction between the powder paint and a transportation face surrounding a transportation path for the powder paint. It is also possible to use an electrostatic powder coating apparatus, which has meshes provided in a transportation path for the powder paint, and which generates static electricity to charge the powder paint by friction between the meshes and the powder paint.

(EXAMPLES)

The electrostatic powder coating method according to the present invention is hereinafter described in more detail by means of the following examples and comparative examples.

First, blue powder paints having the composition shown below were produced.

- Polyester resin (ER-8100, produced by Nippon Ester Co., Ltd., acid value=65.8 mg KOH/g) 60 parts
- Polyester resin (ER-8107, produced by Nippon Ester Co., Ltd., acid value=32.5 mg KOH/g) 40 parts
- Copper phthalocyanine (Cyanine Blue KRS, produced by Sanyo Color Works Ltd.) 7 parts
- Titanium oxide (Tipaque CR-90, produced by Ishihara Sangyo Kaisha Ltd.) 15 parts
- Hardener TGIC (Araldite PT810, produced by Ciba-Geigy Ltd.) 10 parts
- Leveling agent (Acronal 4F, produced by BASF Aktigen Gesellshaft) 1 part After the above ingredients were thoroughly mixed by using the Super Mixer (produced by KAWATA MFG., LTD.), the mixture was kneaded by using the Ko-Kneader APC30 (produced by Buss Japan Ltd.), cooled, and milled by using the PJM milling machine (produced by Nippon Pneumatic Mfg. Co., Ltd.) to yield a first blue powder paint having a mean particle diameter of 20 $\mu$m and a second blue powder paint having a mean particle diameter of 45 $\mu$m. Further, 100 parts of the first blue powder paint was uniformly admixed with 0.1 part of silica (R972, produced by Nippon Aerosil Co.) as a fluidity improver without melting by using a Henschel mixer (produced by Mitsui Mining Co., Ltd.) to yield a third blue powder paint.

Next, red powder paints having the composition shown below were produced.

Polyester resin (ER-8100, produced by Nippon Ester Co., Ltd., acid value=65.8 mg KOH/g) 100 parts Carmine 6B (Sumikaprint.Carmine 6BC, produced by Sumitomo Chemical Co.) 7 parts Titanium oxide (Tipaque CR-90, produced by Ishihara Sangyo Kaisha Ltd.) 15 parts Hardener TGIC (Araldite PT810, produced by Ciba-Geigy Ltd.) 10 parts Leveling agent (Acronal 4F, produced by BASF Aktigen Gesellshaft) 1 part In the same manner as the above-described production of blue powder paints, a first red powder paint having a mean particle diameter of 20 μm and a second red powder paint having a mean particle diameter of 45 μm were obtained. Further, 100 parts of the first red powder paint was uniformly admixed with 0.1 part of silica (R972, produced by Nippon Aerosil Co.) as a fluidity improver without melting by using a Henschel mixer to yield a third red powder paint.

Table 1 below shows physical property data, that is, charge amount, softening point, and apparent density of each powder paint. The data of each of the powder paints were measured before the mixing described later.

The charge amount was determined by measuring the current, which was coming out from a substrate of a given area, and the weight of the powder paint, which was removed when the powder paint was removed by air blow from the substrate to which the powder paint was coated.

The softening point was determined by loading 20 kg on the powder paint heated in a die, which had 1 mm inside diameter and 1 mm length and was attached to an ordinary flow tester (produced by Shimadzu Corporation), to draw an effluent curve showing the relationship between temperature and the amount of effluent, and obtaining the ½ effluent temperature on the effluent curve as the softening point.

The apparent density was determined by an ordinary method by using an ordinary powder tester (produced by Hosokawa Micron Corporation).

TABLE 1

| | Charge amount (μc/g) | Softening point (°C.) | Apparent density(g/cc) |
|---|---|---|---|
| First blue powder paint | −9.1 | 112 | 0.487 |
| Second blue powder paint | −8.2 | 112 | 0.545 |
| Third blue powder paint | −11.7 | 112 | 0.543 |
| First red powder paint | −8.8 | 108 | 0.477 |
| Second red powder paint | −7.6 | 108 | 0.527 |
| Third red powder paint | −10.5 | 108 | 0.531 |

(Example 1)

50 parts of the first blue powder paint and 50 parts of the first red powder paint were uniformly mixed with each other without melting by using the Henschel mixer. The resulting 100 parts of mixture of the powder paints and 0.1 part of silica (R972, produced by Nippon Aerosil Co.) as a fluidity improver were uniformly mixed with each other without melting by using the Henschel mixer to yield a powder paint. This obtained powder paint was charged, and then a coating film was formed by the charged powder paint, by using a known electrostatic powder coating apparatus (GX5000, produced by Onoda GX Service Co.). Thereafter the coating film was baked.

(Example 2)

By using the electrostatic powder coating apparatus of the above-described embodiment of the present invention, the first blue powder paint, the first red powder paint, and silica (R972, produced by Nippon Aerosil Co.) as a fluidity improver were mixed with each other without melting, and this mixed powder paint was charged and then a coating film was formed by the charged powder paint. Thereafter the coating film was baked. The ratio by weight of the first blue powder paint, the first red powder paint, and the fluidity improver transported by the electrostatic powder coating apparatus was set at 50:50:0.1.

(Comparative Example 1)

50 parts of the first blue powder paint and 50 parts of the first red powder paint were uniformly mixed with each other without melting by using the Henschel mixer. The mixed powder paint was charged, and then a coating film was formed by the charged powder paint, by using the same known electrostatic powder coating apparatus as in Example 1. Thereafter the coating film was baked.

(Comparative Example 2)

50 parts of the third blue powder paint and 50 parts of the third red powder paint were uniformly mixed with each other without melting by using the Henschel mixer. The mixed powder paint was charged, and then a coating film was formed by the charged powder paint, by using the same known electrostatic powder coating apparatus as in Example 1. Thereafter the coating film was baked.

(Comparative Example 3)

By using the electrostatic powder coating apparatus of the above-described embodiment of the present invention, the first blue powder paint and the first red powder paint were mixed with each other without melting, and this mixed powder paint was charged, and then a coating film was formed by the charged powder paint. Thereafter, the coating film was baked. The ratio by weight of the first blue powder paint and the first red powder paint transported by the electrostatic powder coating apparatus was set at 50:50.

(Comparative Example 4)

By using the electrostatic powder coating apparatus of the above-described embodiment of the present invention, the second blue powder paint, the second red powder paint, and silica (R972, produced by Nippon Aerosil Co.) as a fluidity improver were mixed with each other without melting, and this mixed powder paint was charged, and then a coating film was formed by the charged powder paint. Thereafter the coating film was baked. The ratio by weight of the second blue powder paint, the second red powder paint, and the fluidity improver transported by the electrostatic powder coating apparatus was set at 50:50:0.1.

Table 2 below shows the powder paint fluidity condition during coating operation, coating film condition, and coating efficiency in each of the examples and comparative examples. The coating efficiency is shown as the ratio by weight of powder paint, which adhered to the substrate to form the coating film, to the total weight of the supplied powder paint.

TABLE 2

| | Fluidity condition during coating operation | Coating film condition | Coating efficiency |
|---|---|---|---|
| Example 1 | Good | Uniform purple | 95% |
| Example 2 | Good | Uniform purple | 95% |
| Comparative Example 1 | Poor | Ununiform red and blue | 50% |
| Comparative Example 2 | Good | Uniform purple | 85% |
| Comparative Example 3 | Poor | Ununiform red and blue | 75% |
| Comparative Example 4 | Good | Red and blue marble | 95% |

The results shown in Table 2 demonstrate that the present invention makes it possible to improve the fluidity of plural kinds of powder paints during coating operation, to yield a uniform coating film of a uniform hue, and to improve coating efficiency. Table 2 also demonstrates that the electrostatic powder coating apparatus of the present invention makes it possible to improve powder paint fluidity, to yield a uniform coating film of a uniform hue, and to improve coating efficiency, as well as the Henschel mixer.

What is claimed is:

1. An electrostatic powder coating method performed by use of an electrostatic powder coating apparatus that has a body, plural powder paint inlets of the body, a fluidity improver inlet of the body, an outlet of the body, a transportation path formed in the body to communicate each of the inlets with the outlet, and a rotary element having a blade in the transportation path, comprising the steps of:

separately introducing plural kinds of powder paints of different hues and a fluidity improver which possesses a charge control function, into the body by pressurized air;

mixing said plural kinds the powder paints and the fluidity improver in the transportation path without melting for preparation of a mixed powder paint of a desired hue;

electrostatically charging the mixed powder paint containing the fluidity improver in the body; and blowing out the mixed and charged powder paint containing the fluidity improver through the outlet by the pressurized air to electrostatically coat a subject with said mixed and charged powder paint.

2. The electrostatic powder coating method according to claim 1, wherein:

the mixing of the powder paints and the fluidity improver, the charging of the mixed powder paint, the blowing of the charged mixed powder paint to the subject of coating are performed continuously, wherein the powder paints and the fluidity improver are transported together.

3. The electrostatic powder coating method according to claim 2, wherein:

the powder paints and the fluidity improver are mixed with each other by rotating a rotary element having a blade that is rotated by pressurized air.

4. The method according to claim 1, wherein the ratio of the fluidity improver to the plural kinds of powder paints is 0.05 to 1% by weight.

5. The method according to claim 4, wherein said ratio is 0.1 to 0.5% by weight.

6. The method according to claim 4, wherein the fluidity improver is silica.

7. The method according to claim 1, wherein the powder paints have a mean particle diameter of about 20 $\mu$m.

* * * * *